US009773433B2

(12) United States Patent
Kerkar

(10) Patent No.: US 9,773,433 B2
(45) Date of Patent: Sep. 26, 2017

(54) PACKAGING FOR SMOKING PRODUCTS HAVING A MARKING THEREON

(71) Applicant: SICPA HOLDING SA, Prilly (CH)

(72) Inventor: Brahim Kerkar, Pully (CH)

(73) Assignee: SICPA HOLDING SA, Prilly (CH)

( * ) Notice: Subject to any disclaimer, the term of this patent is extended or adjusted under 35 U.S.C. 154(b) by 0 days.

(21) Appl. No.: 14/456,297

(22) Filed: Aug. 11, 2014

(65) Prior Publication Data

US 2015/0041345 A1 Feb. 12, 2015

(30) Foreign Application Priority Data

Aug. 12, 2013 (EP) ..... EP13180115

(51) Int. Cl.

| | |
|---|---|
| ***G09F 3/02*** | (2006.01) |
| ***B65D 85/10*** | (2006.01) |
| ***G09F 3/00*** | (2006.01) |
| ***B65B 19/02*** | (2006.01) |
| ***A24F 15/12*** | (2006.01) |
| ***A24D 1/02*** | (2006.01) |

(52) U.S. Cl.

CPC ..... *G09F 3/0291* (2013.01); *A24D 1/02* (2013.01); *A24F 15/12* (2013.01); *B65B 19/02* (2013.01); *B65D 85/10* (2013.01); *G09F 3/02* (2013.01); *B65D 2203/00* (2013.01); *G09F 2003/0213* (2013.01); *G09F 2003/0272* (2013.01)

(58) Field of Classification Search

CPC ..... A24D 1/02; A24F 15/12; B65D 85/10; B65D 85/12; B65D 2203/00; B65B 19/02; G09F 3/02; G09F 3/0291; G09F 2003/0213; G09F 2003/0272

USPC ..... 206/242–276, 459.5

See application file for complete search history.

(56) References Cited

U.S. PATENT DOCUMENTS

| | | | | | |
|---|---|---|---|---|---|
| 178,538 | A * | 6/1876 | Marburg | B65D 85/10 | 206/459.5 |
| 3,476,239 | A * | 11/1969 | Yuash | B65D 75/36 | 206/459.5 |
| 4,431,693 | A * | 2/1984 | Skukowski | C09D 11/50 | 206/459.5 |
| 5,524,758 | A * | 6/1996 | Lupul | B65D 5/54 | 206/459.5 |
| 6,246,778 | B1 * | 6/2001 | Moore | G07B 17/00435 | 340/5.1 |
| 6,766,951 | B2 * | 7/2004 | von Bismarck | B65B 61/025 | 235/435 |
| 7,207,155 | B2 * | 4/2007 | Draghetti | B65D 85/1072 | 206/273 |
| 7,938,124 | B2 * | 5/2011 | Izumiya | A24C 5/005 | 131/280 |

(Continued)

FOREIGN PATENT DOCUMENTS

| | | | | |
|---|---|---|---|---|
| GB | 2309021 A * | 7/1997 | ..... | B65D 5/4216 |
| WO | 2007/060133 | 5/2007 | | |

(Continued)

*Primary Examiner* — Bryon Gehman

(74) *Attorney, Agent, or Firm* — Greenblum & Bernstein, P.L.C.

(57) ABSTRACT

A packaging for smoking products having an area with a warning relating to the health hazards of smoking thereon. The area includes at least one marking that is suitable for identification and/or authentication and/or track and/or trace purposes.

29 Claims, 2 Drawing Sheets

(56) References Cited

U.S. PATENT DOCUMENTS

| | | | | |
|---|---|---|---|---|
| 8,418,847 | B2 * | 4/2013 | Stuckey | A24F 15/18 206/259 |
| 8,657,114 | B2 * | 2/2014 | Oates | B65D 75/52 206/459.5 |
| 8,734,678 | B2 * | 5/2014 | Marguerettaz | G06K 19/06046 106/31.13 |
| 8,763,349 | B2 * | 7/2014 | Prahm | B65D 85/1072 53/410 |
| 8,864,037 | B2 | 10/2014 | Callegari et al. | |
| 9,200,204 | B2 * | 12/2015 | Marguerettaz | G06K 19/06046 |
| 2006/0118437 | A1 * | 6/2006 | Gosebruch | G06K 17/00 206/273 |
| 2010/0200649 | A1 | 8/2010 | Callegari et al. | |
| 2010/0307376 | A1 | 12/2010 | Aboutanos et al. | |
| 2011/0290694 | A1 * | 12/2011 | Fuisz | A61J 3/00 206/459.5 |
| 2011/0293899 | A1 | 12/2011 | Tiller et al. | |
| 2013/0233750 | A1 * | 9/2013 | Ikuta | B65B 5/06 206/459.5 |
| 2013/0256415 | A1 | 10/2013 | Callegari et al. | |

FOREIGN PATENT DOCUMENTS

| | | |
|---|---|---|
| WO | 2008/000755 | 1/2008 |
| WO | 2008/128714 | 10/2008 |

* cited by examiner

PACKAGING FOR SMOKING PRODUCTS HAVING A MARKING THEREON

CROSS-REFERENCE TO RELATED APPLICATIONS

The present application claims priority under 35 U.S.C. §119(a) of European Patent Application No. 131 80 115.1 filed Aug. 12, 2013, the disclosure of which is expressly incorporated by reference herein in its entirety.

BACKGROUND OF THE INVENTION

1. Field of the Invention

The present invention relates to a packaging for smoking products with a marking thereon.

2. Discussion of Background Information

Counterfeiting is no longer a national or a regional problem but a worldwide problem that has an impact not only on manufacturers but also on the consumer. Counterfeiting has also an impact on government revenues in that it affects the collection of taxes for, in particular, cigarettes and alcohol because of the existence of a black market where it is impossible to track and trace counterfeit (smuggled, diverted, etc.) products with no valid tax stamps.

Many solutions have been proposed to make counterfeiting impossible or at least very difficult and/or costly, for example RFID solutions and the use of invisible inks or mono-dimensional or bi-dimensional codes as unique identifiers to avoid (or at least to limit drastically) the existence of fake, diversion and/or counterfeit. However, problems still exist. For example, one problem with a packaging for smoking products such as cigarettes, cigars and the like is to provide the packaging with a marking or coding that does not affect the overall design and appearance of the packaging. Further, the marking and coding should be capable of being automatically recognized by an authentication device and should not change from one packaging to the next, i.e., should not depend on the brand, type and/or manufacturer of the smoking products.

SUMMARY OF THE EMBODIMENTS

The present invention provides a packaging for smoking products wherein the packaging comprises an area that carries a warning relating to the health hazards of smoking printed thereon. The area comprises at least one security feature in the form of a marking that is suitable for identification and/or authentication and/or tracking and/or tracing purposes.

In one aspect of the packaging, the warning may comprise a plurality of characters which optionally are present within a box formed by printed lines. The plurality of characters may comprise alphanumeric characters.

In another aspect, the at least one marking or a part thereof may be present in the form of one or more characters among the plurality of characters. If the at least one marking or a part thereof is present in the form of at least two characters among the plurality of characters said at least two characters may be separated by a predetermined number of additional characters.

In yet another aspect of the packaging, the at least one marking or a part thereof may be present above and/or below one or more characters of the plurality of characters.

In a still further aspect, the at least one marking or a part thereof may be present in the form of at least a part of one or more optional lines which form a box that surrounds the plurality of characters.

In another aspect, the at least one marking or at least a part thereof may invisible to the unaided eye.

In another aspect, the at least one marking or a part thereof may be present as at least one of a cloud of dots, randomly distributed dots, one or more glyphs, a data matrix, a barcode, one or more optionally encoded and/or encrypted characters, and flakes comprising a chiral liquid crystal polymer (CLCP).

In another aspect of the packaging of the present invention, the at least one marking or at least a part thereof (e.g., a character) may comprise a luminescent ink and/or the at least one marking or at least a part thereof may be made with an ink that differs from the ink used for generating the warning (e.g., for printing the characters and/or the lines of the optional box) only in that it has luminescent properties or it may be made with an ink that is different from the ink used for generating the warning to provide supplemental encoded information. Further, two or more characters of the warning or two or more of the optional lines may be printed with different inks, which in itself provides additional coding.

In a still further aspect of the packaging, the packaging or at least a part thereof (e.g., the area which carries the health warning) may carry a plastic or polymer film or sheet thereon. Said plastic or polymer film or sheet may comprise a marking that is invisible to the unaided eye such as, e.g., a marking comprising luminescent particles and/or luminescent dyes and/or luminescent flakes. Further, the marking of the plastic or polymer sheet may be different from the marking in the area of the health warning on the packaging.

In another aspect of the packaging of the present invention, the packaging may be a packaging for cigarettes.

The present invention also provides a smoking product that is contained in a packaging of the present invention as set forth above (including the various aspects thereof).

The present invention also provides a cigarette packet which comprises the packaging of the present invention as set forth above (including the various aspects thereof).

In one aspect of the packet, the packet may be enclosed (e.g., sealed) within a (preferably airtight) plastic or polymer film. The plastic or polymer film may optionally comprise a marking that is invisible to the unaided eye such as, e.g., a marking comprising luminescent particles and/or luminescent dyes and/or luminescent flakes.

In another aspect of the packet, the paper used for making the cigarettes may comprise one or more fluorescent substances.

The present invention also provides a method of providing a packaging for smoking products with a marking. The packaging comprises an area that carries a warning relating to the health hazards of smoking printed thereon. The method comprises providing on the area at least one marking that is suitable for identification and/or authentication and/or tracking and/or tracing purposes.

In one aspect of the method, packages for smoking products that are intended for sale in different countries but have identical health warnings thereon may be provided with markings which differ with respect to at least one property thereof so as to be able to distinguish packages intended for marketing in different countries from each other. For example, the markings may differ with respect to at least the absorption and/or emission properties of the inks used for making these markings or a part thereof.

The present invention also provides a method of enhancing the identifiability and/or authenticability and/or trackability and/or traceability of a packaging that contains smoking products and comprises an area with a warning relating to health hazards of smoking thereon. The method comprises providing said area with at least one marking that is suitable for identification and/or authentication and/or tracking and/or tracing purposes.

BRIEF DESCRIPTION OF THE DRAWINGS

The present invention is further described in the detailed description which follows, in reference to the drawings wherein.

DETAILED DESCRIPTION OF THE EMBODIMENTS

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

The packaging of the present invention may be any packaging that is used for smoking products and in particular, tobacco products. The packaging for cigarettes almost always comprises paperboard that is formed into a (usually rectangular) container (box). In this case the health warning is usually present (printed) directly on the packaging material (e.g., paperboard) itself. Cigars are sometimes sold in a box made of wood or cardboard. Especially if the container is made of wood the warning is frequently present on a label applied to the container. In the case of loose tobacco for smoking in a pipe or for self-made (rolled) cigarettes the packaging often is present in the form of a bag of plastic or laminated paper/plastic material. The health warning will in this case usually be present directly on the bag or on a label applied to the bag.

Figure 1:
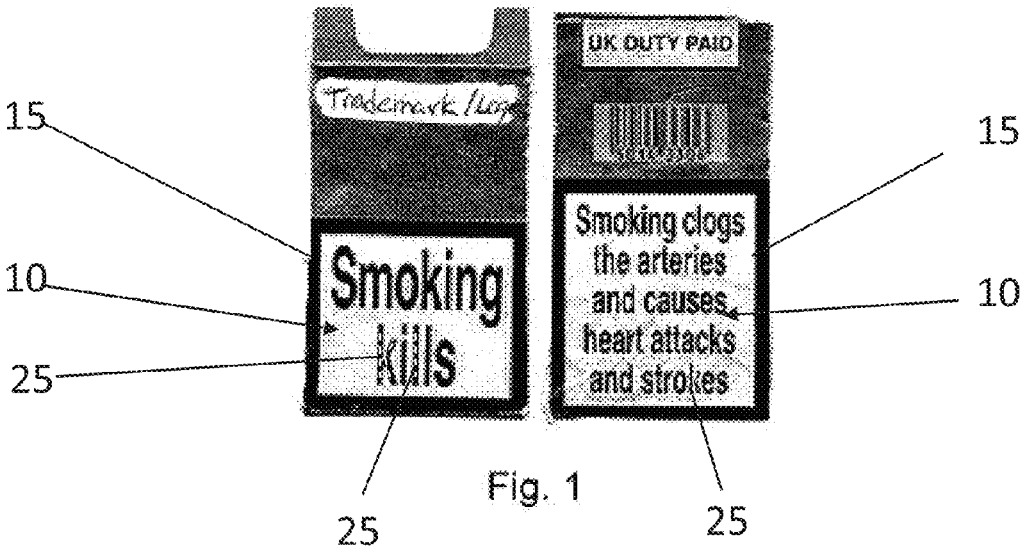
FIG. 1 shows a first example of a packaging for cigarettes comprising an area with a typical warning regarding the health hazards of smoking printed thereon and which is suitable for use in the present invention.
Figure 2:
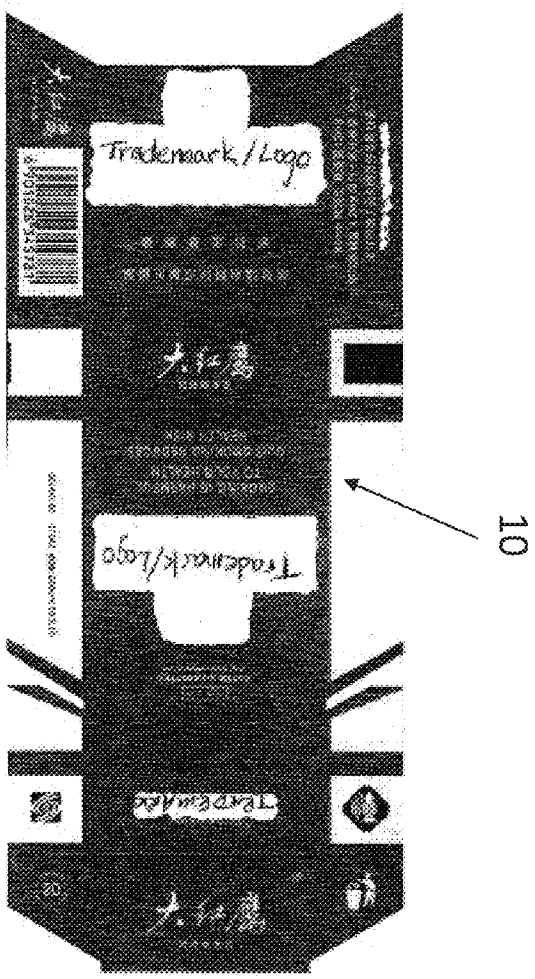
FIG. 2 shows a second example of a packaging for cigarettes comprising an area with a typical warning regarding the health hazards of smoking printed thereon and which is suitable for use in the present invention.
Figure 3:
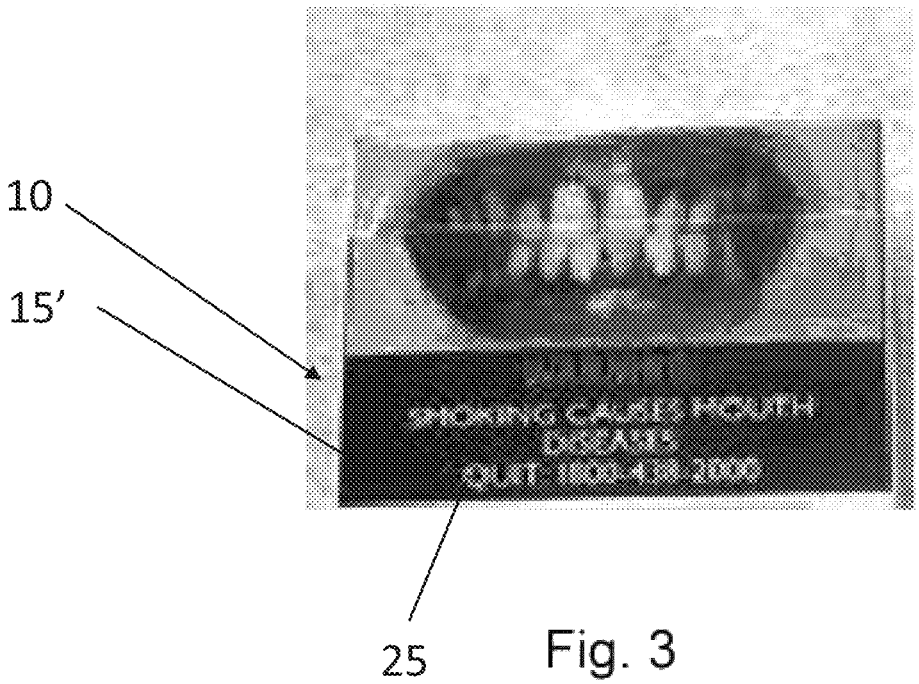
FIG. 3 shows a third example of a packaging for cigarettes comprising an area with a typical warning regarding the health hazards of smoking printed thereon and which is suitable for use in the present invention.

The present invention takes advantage of the fact that in most countries the packaging for smoking products is required by law to have a warning relating to the health hazards of smoking products printed thereon. As shown in FIG. 1, the warning is typically in the form of alphanumeric characters in a demarcated warning area 10, often demarcated with a marked border around them, usually a rectangular box formed by straight lines 15, or, as shown in FIG. 3, within a (usually rectangular) area having a color 15' that is different from the color(s) of the packaging that surround the warning area 10. According to the present invention, the demarcated warning area 10 that carries the warning and/or one or one or more elements thereof (e.g., one or more characters and/or one or more lines that optionally form a border around the characters) are used as (invariable) reference point(s) for the positioning of (preferably encoded) information on the packaging. Accordingly, there is no need to search for a reference mark or reference point for locating the marking 25 on the packaging. Rather, the marking 25 will always be in a position that is predictable and readily locatable, i.e., the demarcated warning area 10 of the packaging that carries the health warning thereon.

As set forth above, the warning on the packaging of the present invention may comprise a plurality of (printed) characters which optionally are present within a box formed by, e.g., (printed) lines 15 and/or within an area of a color 15' that differs from the color(s) of the surrounding area(s). The plurality of characters may comprise alphanumeric characters and may also comprise characters different from alphanumeric characters (for example, characters corresponding to the language of a particular country in which the smoking products are to be marketed) instead of or in addition to the alphanumeric characters. For example, the different characters may be characters used for writing in a language that does not use alphanumeric characters such as Chinese, Japanese, Korean, Indian, Russian, Greek, Arabic, etc.

As schematically shown in FIG. 1, the at least one marking 25 or at least a part thereof is present inside the area 10 that carries the warning, for example, inside a box formed by printed lines 15 and/or an area of a color that is different from the color(s) of surrounding areas. Preferably the entire marking 25 is present inside the area 10 that carries the warning, although it is possible for the marking to extend beyond that area so that a part of the marking is outside the area. For example, the at least one marking 25 or a part thereof may be present in the form of and/or above and/or below one or more characters (such as, e.g., a letter). If the marking 25 is present in the form of and/or above and/or below two or more characters the at least two characters may be separated by a predetermined number of additional remaining characters. For example, as schematically shown in FIG. 1, the marking 25 may be present in the form of and/or above and/or below two or more characters which are invariably separated by 1, 2, 3, 4, 5, 6, 7, 8, 9 or 10 remaining characters (without associated marking).

The at least one marking 25 or at least a part thereof may be invisible to the unaided eye (upon irradiation with light in the visible range). If invisible, the marking 25 may be detectable by a device, e.g., upon irradiation with a light source that emits radiation in a wavelength range (e.g., IR, near-IR or UV) that is absorbed or reflected by the material of the marking (for example, the ink(s) used for producing the marking 25). Further, at least a part of the material (e.g., ink) from which the marking 25 is made may have magnetic properties. In the latter case the marking 25 would be detectable by a device that responds to magnetism and is able to process magnetic information.

The at least one marking 25 present on the packaging of the present invention preferably is printable and in particular, machine readable. The marking 25 may, for example, comprise cells, dots, microdots, bars, micro alphanumeric characters, glyphs, flakes or any combination of two or more thereof. It may be present in the form of, for example, a cloud of dots, randomly distributed dots (which may serve as a basis for a unique fingerprint identity of the packaging), one or more glyphs (which may support encoded information which optionally is encoded), a data matrix, a 1-dimensional barcode, a stacked 1-dimensional barcode, a 2-dimensional barcode, one or more optionally encoded and/or encrypted characters, flakes comprising a chiral liquid crystal polymer (CLCP), and any combination of two or more of these forms. If the cloud of dots comprises dots which are not randomly distributed it may support encoded information which optionally may be encrypted (as in the case of the one or more glyphs).

Non-limiting examples of elements which are suitable as marking for use in the present invention include microdots, microtaggants, micromarkings (e.g., in the form of a microbarcode or a microdatamatrix), and micro alphanumeric characters. Further non-limiting examples of types of designs which are suitable for use in the present invention include clouds of dots. The clouds of dots may be in the form of, for example, distributions of particles or flakes or ink droplets, where the distribution thereof is determined by a mathematical algorithm. They may be printed with a very high resolution that renders them difficult to reproduce. Another type of cloud of dots that is suitable for use in the present invention is represented by sums of glyphs which represent a code having a unique auto-ID. The glyphs can take arbitrary shapes and forms. For example, the glyphs may be in the form of micro 45° diagonal lines (preferably invisible to the unaided eye) and their orientation in one or the other direction may correspond to 0 or 1 in a binary code, whereby a sum of glyphs which individually are oriented in a specific manner can represent a specific code and can provide data or information. Yet another non-limiting type of cloud of dots is represented by tags on a surface having an optically readable pattern. Each tag has a background pattern that defines a discrete area. The background pattern is common to all tags. Each tag further has coded data positioned within the discrete areas. The coded data is represented by a plurality of optically readable marks positioned according to an encoding scheme. The background pattern is distinguishable from the coded data.

The at least one marking may, for example, have been formed by digital printing. However, the marking may also be formed by any conventional printing method (e.g., offset, rotogravure, screen printing, letterpress, flexography, intaglio, etc.) or any other method known to those of skill in the art. An exemplary method for producing the marking is ink-jet printing (for example, continuous ink-jet printing, drop-on-demand ink-jet printing, or valve-jet printing). The industrial ink-jet printers, commonly used for numbering, coding and marking applications on conditioning lines and printing presses, are particularly suitable for this purpose. Preferred ink-jet printers include single nozzle continuous ink-jet printers (also called raster or multi level deflected printers) and drop-on-demand ink-jet printers, in particular valve-jet printers.

The marking or at least one or more parts thereof may have been formed with a black ink, such as conventional carbon black ink. Of course, inks of a different color may be used as well. The ink may also be an invisible ink with a $\lambda_{max}$ or a $\lambda_{max}$ range of a specific absorption or emission wavelength.

The black ink may, for example, be a conventional carbon black ink as it commonly is used for printing, for example, newspapers, magazines, and the like. The black ink may further be an IR absorbent ink (i.e., an ink that absorbs IR radiation) that provides a hidden code (i.e., hidden information) that is detectable (readable) only with the aid of a light source that emits radiation in the IR range. By the same token, the black ink may be an IR transparent ink (i.e., a black ink that lets IR radiation pass through). All of these types of inks are readily commercially available. Of course, the marking may be made by two or more different inks. Merely by way of example, a part of the marking may be produced (e.g., printed) with an IR absorbent ink and another part of the code may be produced with an IR transparent ink. Another type of material that can be used for producing the marking or a part thereof is a chiral liquid crystal polymer (CLCP) composition.

In a still further aspect of the packaging according to the present invention, the marking thereon may comprise one or more materials selected from flakes, fibers, inorganic compounds, organic compounds, dyes, pigments, absorber materials absorbing electromagnetic radiation in the UV and/or visible and/or near-IR and/or IR range, luminescent materials (optionally having specific decay time properties), fluorescent materials, phosphorescent materials, colored materials, photochromic materials, thermochromic materials, magnetic materials, and materials having one or more detectable particle size distributions (e.g., having a monomodal or a polymodal size distribution).

The one or more luminescent materials, if present, may comprise one or more lanthanide compounds such as, e.g., complexes of lanthanides and β-diketo compounds.

Non-limiting examples of fluorescent materials include VAT dyes, perylene, terrylene, quaterrylene derivatives, such as those disclosed in US 2011/0293899 A1.

Non-limiting examples of pigments that are suitable for use in the present invention include those disclosed in WO 2008/000755.

Further non-limiting examples of the one or more materials include salts/complexes of the rare earth metals (scandium, yttrium and the lanthanides such as Ce, Pr, Nd, Sm, Eu, Gd, Tb, Dy, Ho, Er, Tm, and Yb) and the actinides. Non-limiting examples of these salts and complexes are disclosed in US 2010/0307376 A1.

Non-limiting examples of IR absorber materials include those disclosed in WO2007/060133. Non-limiting examples of specific materials include copper(II) fluoride ($CuF_2$), copper hydroxyfluoride (CuFOH), copper hydroxide ($Cu(OH)_2$), copper phosphate hydrate ($Cu_3(PO_4)_2*2H_2O$), anhydrous copper phosphate ($Cu_3(PO_4)_2$), basic copper(II) phosphates (e.g. $Cu_2PO_4(OH)$, "Libethenite" whose formula is sometimes written as $Cu_3(PO_4)\ 2*Cu(OH)_2$; $Cu_3(PO_4)(OH)_3$, "Cornetite", $Cu_5(PO_4)_3(OH)_4$, "Pseudomalachite", $CuAl_6(PO_4)_4(OH)_8.5H_2O$ "Turquoise", etc.), copper (II) pyrophosphate ($Cu_2(P_2O_7)*3H_2O$), anhydrous copper(II) pyrophosphate ($Cu_2\ (P_2O_7)$), copper(II) metaphosphate ($Cu(PO_3)_2$, more correctly written as $Cu_3(P_3O_9)_2$), iron(II) fluoride ($FeF_2*4H_2O$), anhydrous iron(II) fluoride ($FeF_2$), iron(II) phosphate ($Fe_3(PO_4)_2*8H_2O$, "Vivianite"), lithium iron(II) phosphate ($LiFePO_4$, "Triphylite"), sodium iron(II) phosphate ($NaFePO_4$, "Maricite"), iron(II) silicates ($Fe_2SiO_4$, "Fayalite"; $FexMg_2xSiO_4$, "Olivine"), iron(II) carbonate ($FeCO_3$, "Ankerite", "Siderite"); nickel(II) phosphate ($Ni_3(PO_4)_2*8H_2O$), and titanium(III) metaphosphate ($Ti(P_3O_9)$). Moreover, a crystalline IR absorber may also be a mixed ionic compound, i.e., where two or more cations are participating in the crystal structure, as e.g. in $Ca_2Fe(PO_4)_2*4H_2O$, "Anapaite". Similarly, two or more anions can participate in the structure as in the mentioned basic copper phosphates, where $OH^-$ is the second anion, or even both together, as in magnesium iron phosphate fluoride, $MgFe(PO_4)F$, "Wagnerite". Additional non-limiting examples of materials for use in the present invention are disclosed in WO 2008/128714 A1.

The one or more magnetic materials (including soft magnetic materials and hard magnetic materials) for (optional) use in the marking of the packaging of the present invention may comprise at least one material selected from ferromagnetic materials, ferrimagnetic materials, paramagnetic materials, and diamagnetic materials. For example, the one or more magnetic materials may comprise at least one material selected from metals and metal alloys comprising at least one of iron, cobalt, nickel, and gadolinium. Further, the magnetic material may comprise, without limitation, an alloy of iron, cobalt, aluminum, and nickel (with or without copper, niobium and/or tantalum), such as Alnico, or an alloy of titanium, nickel, cobalt, aluminum, and iron, such as Ticonal; and ceramics. The one or more magnetic materials may also comprise at least one material selected from inorganic oxide compounds such as maghemite and/or hematite, ferrites of formula $MFe_2O_4$, wherein M represents Mg, Mn, Co, Fe, Ni, Cu or Zn, and garnets of formula $A_3B_5O_{12}$, wherein A represents La, Ce, Pr, Nd, Sm, Eu, Gd, Tb, Dy, Ho, Er, Tm, Yb, Lu or Bi, and B represents Fe, Al, Ga, Ti, V, Cr, Mn or Co.

The one or more materials may be substantially invisible under light within the visible spectrum but visible under light outside the visible spectrum, such as UV, near-IR or IR light.

Additional non-limiting examples of the one or more materials having detectable properties of the marking for use in the present invention include particles and, in particular, flakes which are made of, or comprise a CLCP material. Corresponding flakes may be randomly distributed, for example in the area that carries the warning or a part thereof, and may have an average size (largest dimension) of from about 20 μm to about 100 μm. They may have a monomodal or a polymodal (e.g., bimodal) particle size distribution.

The CLCP particles of flakes may further be present in the form of multilayer particles or flakes, such as those disclosed in U.S. provisional Application No. 61/616,133, filed Mar. 27, 2012, U.S. application Ser. No. 13/801,053, filed Mar. 13, 2013, and US 2010/0200649 A1. The multilayer flakes disclosed in these documents comprise at least two CLCP layers comprising a first CLCP layer that has a first detectable parameter and a second CLCP layer including a second detectable parameter, and at least one additional layer including a third detectable parameter, the at least one additional layer comprising a material that is not a chiral liquid crystal polymer. The third detectable parameter is different from each of the first detectable parameter and the second detectable parameter. The additional layer may be made with luminescent and/or magnetic material. The magnetic material (including soft magnetic materials and hard magnetic materials) may comprise at least one material selected from ferromagnetic materials, ferrimagnetic materials, paramagnetic materials, and diamagnetic materials. For example, the magnetic material may comprise at least one material selected from metals and metal alloys comprising at least one of iron, cobalt, nickel, and gadolinium. For example, the magnetic material may comprise, without limitation, an alloy of iron, cobalt, aluminum, and nickel (with or without copper, niobium, and/or tantalum), such as Alnico, or an alloy of titanium, nickel, cobalt, aluminum, and iron, such as Ticonal; ceramics; and ferrites. The magnetic material may also comprise at least one material selected from inorganic oxide compounds, ferrites of formula $MFe_2O_4$, wherein M represents Mg, Mn, Co, Fe, Ni, Cu or Zn, and garnets of formula $A_3B_5O_{12}$, wherein A represents La, Ce, Pr, Nd, Sm, Eu, Gd, Tb, Dy, Ho, Er, Tm, Yb, Lu or Bi, and B represents Fe, Al, Ga, Ti, V, Cr, Mn or Co. The luminescent material that may be present in the additional layer of the flakes may, for example, comprise at least one complex of a lanthanide and a β-diketo compound.

As set forth above, the packaging of the present invention (or at least one or more parts thereof) may optionally carry a plastic or polymer film or sheet thereon (e.g., laminated to the packaging). Said plastic or polymer film or sheet may optionally comprise a marking that preferably is invisible under light in the visible range. Non-limiting examples of corresponding markings include markings that consist of or comprise luminescent particles and/or luminescent dyes and/or luminescent flakes.

Further, for example in the case of cigarettes, the packaging that contains the smoking product (e.g., a cigarette packet) will usually be enclosed in a plastic or polymer film (usually an airtight film). Also this film may optionally comprise a marking that preferably is invisible under light in the visible range. As in the case of the plastic or polymer film or sheet attached to the packaging itself discussed above, non-limiting examples of corresponding markings of the enclosing plastic or polymer film of a packaged smoking product include markings that consist of or comprise luminescent particles and/or luminescent dyes and/or luminescent flakes.

One advantage of the packaging for smoking products of the present disclosure is that it comprises a marking that allows one to identify, authenticate and/or track and/or trace the packaging and that can readily be located on any packaging—regardless of brand, type or manufacturer of the smoking product—because its position is linked to the position of a feature of the packaging, i.e., a health warning, that is invariably present on the packaging because its presence is required by law. In other words, the health warning serves as a reference for locating the marking (security feature) that is present on the packaging. This has several advantages. First, whatever the orientation of the packaging may be, the health warning will always be readily locatable, and once located, the information supported by the health warning will be readily locatable and retrievable. Second, one does not need a camera or a device with electronic software that will generate a specific virtual reference mark according to the identity of a packaging. The third advantage (which is linked to the second one) is that it reduces the time for the processor analysis of the information contained in/on the packaging. Fourth, the packaging takes advantage of a feature of the packaging that is required by law. Thus, utilizing the present embodiments saves the time and money that would otherwise have to be spent in order to find a compromise between the design of the packaging and the insertion of a conventional code, which affects the design of the packaging.

It further is to be appreciated that the packaging of the instant invention provides a simple and elegant way of making it possible to provide packaging for smoking products such as, e.g., cigarettes, that are to be marketed in different countries that share a common language (e.g., Spanish in, e.g., most South American countries and Spain or English in, e.g., the U.S., Canada, Australia, Great Britain and Ireland) with a country-specific marking without changing the outer appearance of the packaging. For example, one or more (or all) characters and/or lines of the health warning may be printed with black inks that are indistinguishable with the unaided eye, but which contain substances with different absorption/reflection characteristics with respect to light in the visible, UV and IR ranges, to thereby generate health warnings that look the same but still differ from country to country.

An additional way of making the packaging for smoking products that are intended for sale in different countries that share a common language distinguishable without changing the outer appearance of the packaging (including the health warning) is to include in a polymer or plastic film or sheet that is optionally present on at least a part of the packaging an invisible marking in the form of, for example, luminescent particles and/or luminescent dyes and/or luminescent flakes. The marking can be made of different materials for each country, but the difference will only be detectable upon irradiating the packaging with radiation outside the visible range (e.g., UV, near-IR or IR). The same applies to the polymer or plastic film that may optionally be present to enclose (seal) a packet of cigarettes. In this case, too, the corresponding film may include a marking that differs from country to country but is visible only upon irradiating the packet with radiation outside the visible range.

At least in the case of cigarettes as the smoking products, there even is an additional way of rendering packets of cigarettes that are intended for sale in different countries that share a common language distinguishable without changing the outer appearance of the packets (including the health warning). In particular, one or more fluorescent compounds that are generally recognized as safe (GRAS compounds) may be incorporated in and/or applied onto the paper that is used for making the cigarettes. These substances, non-limiting examples of which include riboflavin, riboflavin-(5')-phosphate, pyridoxine hydrochloride, folic acid, quinine sulphate, niacin, nicotinamide, and D&C Orange No. 5, are invisible under visible light but emit radiation in the visible range (fluoresce) when they are irradiated with radiation in the UV range. In this case, cigarettes intended for sale in different countries can be made distinguishable by including in the paper used for making the cigarettes different fluorescent compounds (or mixtures of fluorescent compounds) with different wavelengths of the emitted visible radiation upon irradiation with UV light.

To sum up, according to embodiments of the present disclosure, smoking products intended for sale in different countries can be rendered distinguishable without (visible) change of the packaging by, for example, one or more of the following measures:

using inks that contain invisible luminescent substances that are different from one country to the next for printing the health warning or parts thereof;

providing a polymer or plastic film or sheet on the packaging or one or more parts thereof, which film or sheet comprises one or more invisible luminescent substances that differ from country to country;

especially in the case of cigarette packets that are to be enclosed (sealed) by a polymer or plastic film, using a film which comprises one or more invisible luminescent substances that differ from country to country;

in the case of cigarettes themselves, providing the paper for making the cigarettes with invisible fluorescent substances that differ from country to country.

The above options may be illustrated by the marking of the cigarette packaging shown in FIG. 1 which reads "Smoking kills" If one had to provide packets of cigarettes to be sold in the US, Canada and Great Britain that are distinguishable (e.g., to curb parallel imports in view of different taxes on tobacco products in these countries), but nevertheless have the same outer appearance one could, for example, proceed as follows:

Packaging for the US market: the word "Smoking" printed with a black ink that contains a substance that absorbs IR radiation between 750 and 800 nm, and the word "kills" printed with a UV ink which emits radiation in the visible range and absorbs radiation in a range of from 250 to 300 nm.

Packaging for the British market: the word "Smoking" printed with a black ink that contains a substance that absorbs UV radiation between 350 and 380 nm, and the word "kills" printed with a UV ink which emits radiation in the visible range and absorbs radiation in a range of from 250 to 300 nm.

Packaging for the Canadian market: the word "Smoking" printed with a black ink that contains a invisible CLCP flakes which have a $\lambda_{max}$ comprised between 800 and 900 nm, and the word "kills" printed with a UV ink which emits radiation in the visible range and absorbs radiation in a range of from 250 to 300 nm.

Although these packages would be indistinguishable under visible light, they would be distinguishable by using a device that can process different absorption and emission characteristics in the visible, UV and IR ranges. Of course, each of these packages may contain one or more additional (identical) markings (security features) in the area of the health warning (and/or anywhere else on the packaging).

For example, additionally or alternatively to the above, the cigarettes intended for sale in these different countries can be rendered distinguishable by providing a polymer or plastic film or sheet on the packaging or parts thereof, which sheet or film includes one or more luminescent substances that are invisible under radiation in the visible range and are different for each of the countries.

Additionally or alternatively to the above, the cigarettes intended for sale in these different countries can be rendered distinguishable by enclosing the cigarette packets in a polymer of plastic film, which film includes one or more luminescent substances that are invisible under radiation in the visible range and that are different for each of the countries.

Additionally or alternatively to the above, the cigarettes intended for sale in these different countries can be rendered distinguishable by providing the paper used for making the cigarettes with one or more fluorescent compounds that are invisible under radiation in the visible range and that are different for each of the countries.

It is noted that the foregoing examples have been provided merely for the purpose of explanation and is in no way to be construed as limiting of the present invention. While the present invention has been described with reference to exemplary embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

The invention claimed is:

1. A packaging for smoking products, wherein the packaging comprises a demarcated warning area defined by at least one of a marked border having lines and an area of color that is different from colors of the packaging surrounding the demarcated warning area, wherein the demarcated warning area carries a warning relating to health hazards of smoking thereon within the demarcated warning area, and wherein the demarcated warning area further comprises at least one marking for at least one of identification purposes, authentication purposes, tracking purposes, and tracing purposes.

2. The packaging of claim 1, wherein the warning comprises a plurality of characters.

3. The packaging of claim 2, wherein the characters are present within a box formed by the lines.

4. The packaging of claim 2, wherein the characters comprise alphanumeric characters.

5. The packaging of claim 2, wherein the at least one marking or a part thereof is present in the form of one or more characters among the plurality of characters.

6. The packaging of claim 5, wherein the at least one marking or a part thereof is present in the form of at least two characters among the plurality of characters and said at least two characters are separated by a predetermined number of remaining characters.

7. The packaging of claim 2, wherein the at least one marking or a part thereof is present at least one of above and below one or more characters of the plurality of characters.

8. The packaging of claim 3, wherein the at least one marking or a part thereof is present in the form of at least a part of one or more lines which form the box.

9. The packaging of claim 1, wherein the at least one marking or a part thereof is invisible to the unaided eye.

10. The packaging of claim 1, wherein the at least one marking or a part thereof is present as at least one of a cloud of dots, randomly distributed dots, one or more glyphs, a data matrix, a barcode, one or more characters, and flakes comprising a chiral liquid crystal polymer.

11. The packaging of claim 10, wherein the one or more characters comprise at least one of encoded characters and encrypted characters.

12. The packaging of claim 1, wherein the at least one marking or a part thereof comprises a luminescent ink.

13. The packaging of claim 1, wherein the at least one marking or a part thereof comprises a first ink that differs from a second ink used for making the warning only in that the first ink has luminescent properties.

14. The packaging of claim 1, wherein the at least one marking or a part thereof comprises an ink that is different from ink used for making the warning to provide supplemental encoded information.

15. The packaging of claim 1, wherein at least a part of said packaging carries a plastic or polymer film or sheet thereon.

16. The packaging of claim 15, wherein said plastic or polymer film or sheet comprises a second marking that is invisible to the unaided eye.

17. The packaging of claim 16, wherein said second marking comprises at least one of luminescent particles, luminescent dyes, and luminescent flakes.

18. The packaging of claim 16, wherein the second marking of the plastic or polymer film or sheet is different from the marking in the area of the health warning on the packaging.

19. The packaging of claim 1, wherein the packaging is a packaging for cigarettes.

20. A smoking product contained in the packaging of claim 1.

21. A cigarette packet which comprises the packaging of claim 1.

22. The cigarette packet of claim 21, wherein the cigarette packet is enclosed in a plastic or polymer film.

23. The cigarette packet of claim 22, wherein the plastic or polymer film comprises a second marking that is invisible to the unaided eye.

24. The cigarette packet of claim 23, wherein said second marking comprises one or more of luminescent particles, luminescent dyes, and luminescent flakes.

25. The cigarette packet of claim 21, further comprising at least one cigarette, wherein a paper of the cigarettes comprises one or more fluorescent substances.

26. A method of providing a packaging for smoking products with at least one marking, wherein the packaging comprises a demarcated warning area defined by at least one of a marked border having lines and an area of color that is different from colors of the packaging surrounding the demarcated warning area, wherein the demarcated warning area carries a warning relating to health hazards of smoking thereon within the demarcated warning area and wherein the method comprises positioning on the packaging in the demarcated warning area the at least one marking for at least one of identification purposes, authentication purposes, tracking purposes, and tracing purposes.

27. The method of claim 26, wherein packages intended for marketing in different countries but with identical visible warnings are provided with markings that differ, with respect to at least one property thereof, from one country to the next.

28. The method of claim 27, wherein the markings differ with respect to at least one of absorption and emission properties of inks used for printing the markings or parts thereof.

29. A method of enhancing at least one of the identifiability, authenticability, trackability, and traceability of a packaging that contains smoking products and comprises a demarcated warning area defined by at least one of a marked border having lines and an area of color that is different from colors of the packaging surrounding the demarcated warning area, wherein the demarcated warning area carries a warning relating to health hazards of smoking thereon within the demarcated warning area, wherein the method comprises providing the demarcated warning area with at least one marking for at least one of identification purposes, authentication purposes, tracking purposes, and tracing purposes.

* * * * *